US005692486A

United States Patent [19]

Tsutsumi et al.

[11] Patent Number: 5,692,486

[45] Date of Patent: Dec. 2, 1997

[54] AIR-FUEL RATIO SENSOR DETERIORATION-DETECTING SYSTEM FOR INTERNAL COMBUSTION ENGINES

[75] Inventors: Kojiro Tsutsumi; Yuji Fujiki; Toshitaka Hachiro; Shigeto Kashiwabara; Fumio Hara; Sachito Fujimoto, all of Wako, Japan

[73] Assignee: Honda Giken Kogyo Kabushiki Kaisha, Tokyo, Japan

[21] Appl. No.: 726,169

[22] Filed: Oct. 4, 1996

[30] Foreign Application Priority Data

Oct. 6, 1995 [JP] Japan ..... 7-284356

[51] Int. Cl.[6] ..... F02D 41/00; F02M 23/00; F02M 25/00

[52] U.S. Cl. ..... 123/688

[58] Field of Search ..... 123/688, 690; 60/276, 274; 73/23.32, 118.1

[56] References Cited

U.S. PATENT DOCUMENTS 5,396,765 3/1995 Maruyama et al. ..... 60/276
5,462,040 10/1995 Krebs et al. ..... 123/688
5,526,798 6/1996 Seki ..... 123/688
5,577,488 11/1996 Sato et al. ..... 123/688

*Primary Examiner*—Raymond A. Nelli
*Attorney, Agent, or Firm*—Nikaido, Marmelstein, Murray & Oram LLP

[57] ABSTRACT

An air-fuel ratio sensor deterioration-detecting system is provided for an internal combustion engine having first and second air-fuel ratio sensors arranged in the exhaust system upstream and downstream of a catalytic converter therein. An ECU calculates a control parameter, based on an output from the second air-fuel ratio sensor, calculates an air-fuel ratio correction amount, based on an output from the first air-fuel ratio sensor and the calculated control parameter, and executes air-fuel ratio feedback control, based on the calculated air-fuel ratio correction amount. The ECU also determines deterioration of the second air-fuel ratio sensor, based on the output from the same in such a manner that the air-fuel ratio correction amount is increased or decreased by a predetermined amount, based on the output from the second air-fuel ratio when a variation in the second air-fuel ratio sensor output falls within a predetermined small variation range during execution of the air-fuel ratio feedback control, and the second air-fuel ratio sensor is determined to be deteriorated when the output variation falls within the predetermined small variation range even after the increase or decrease of the air-fuel ratio correction amount.

7 Claims, 9 Drawing Sheets

FUEL INJECTION VALVE
6
2
3
θTH
4
PBA
7
8
TA
9
TW
10
NE
11
CYL
12
INTERNAL COMBUSTION ENGINE
1
13
O2
16
THREE-WAY CATALYST
14
O2
17
INPUT CIRCUIT
C P U
MEMORY MEANS
OUTPUT CIRCUIT
ECU
5a
5b
5c
5d
5

AIR-FUEL RATIO SENSOR DETERIORATION-DETECTING SYSTEM FOR INTERNAL COMBUSTION ENGINES

BACKGROUND OF THE INVENTION

1. Field of the Invention

This invention relates to an air-fuel ratio sensor deterioration-detecting system for internal combustion engines, and more particularly to an air-fuel ratio sensor deterioration-detecting system of this kind, which detects deterioration of an air-fuel ratio sensor arranged in the exhaust system of the engine at a location downstream of a catalytic converter arranged therein.

2. Prior Art

To detect deterioration of an air-fuel ratio sensor arranged in the exhaust system of an internal combustion engine at a location downstream of a catalytic converter arranged therein (hereinafter referred to as "the downstream air-fuel ratio sensor"), an air-fuel ratio sensor deterioration-detecting system has been proposed by Japanese Laid-open Patent Publication (Kokai) No. 8-121223 and U.S. Ser. No. 08/549,119 corresponding thereto, which changes a feedback gain in air-fuel ratio feedback control based on an output from the downstream air-fuel ratio sensor arranged in the exhaust system when the output from the downstream air-fuel ratio sensor has a small variation to thereby impart a variation to the controlled air-fuel ratio, and determines that the downstream air-fuel ratio sensor is deteriorated if the output from the downstream air-fuel ratio sensor has maintained a small variation over a predetermined time period even after the imparting of the variation to the controlled air-fuel ratio.

According to the proposed system which varies the controlled air-fuel ratio by changing the feedback gain in the air-fuel ratio feedback control based on the output from the downstream air-fuel ratio sensor, the amount of variation imparted to the controlled air-fuel ratio is so small that when the engine is in a condition where the volume of exhaust gases in the exhaust system is small such as a low rotational speed or low load condition, the resulting variation in the air-fuel ratio in exhaust gases upstream of the catalytic converter does not cause an appreciable amount of variation in the output from the downstream air-fuel ratio sensor. As a result, even if the feedback gain in the air-fuel ratio feedback control based on the output from the downstream air-fuel ratio sensor is changed when the engine is in a condition where the volume of exhaust gases is small, the output voltage from the downstream air-fuel ratio sensor cannot be appreciably changed though the sensor is functioning normally, resulting in an erroneous determination that the downstream air-fuel ratio sensor is deteriorated.

SUMMARY OF THE INVENTION

It is an object of the invention to provide an air-fuel ratio sensor deterioration-detecting system for internal combustion engines, which is capable of detecting deterioration of an air-fuel ratio sensor downstream of a catalytic converter with accuracy even when the engine is in a condition where the volume of exhaust gases is small.

To attain the above object, the present invention provides an air-fuel ratio sensor deterioration-detecting system for an internal combustion engine having an exhaust system, a catalytic converter arranged in the exhaust system, first and second air-fuel ratio sensors arranged in the exhaust system at respective locations upstream and downstream of the catalytic converter, air-fuel ratio control parameter-calculating means for calculating a value of a control parameter, based on an output from the second air-fuel ratio sensor, air-fuel ratio correction amount-calculating means for calculating an air-fuel ratio correction amount, based on an output from the first air-fuel ratio sensor and the calculated value of the control parameter, air-fuel ratio control means for executing air-fuel ratio feedback control in a manner such that an air-fuel ratio of an air-fuel mixture to be supplied to the engine is controlled based on the calculated air-fuel ratio correction amount, and deterioration-determining means for determining whether the second air-fuel ratio sensor is deteriorated, based on the output from the second air-fuel ratio sensor.

The air-fuel ratio sensor deterioration-detecting system according to the invention is characterized by an improvement wherein:

the deterioration-determining means comprises sensor output variation-determining means for determining whether a variation in the output from the second air-fuel ratio sensor falls within a predetermined small variation range during execution of the air-fuel ratio feedback control by the air-fuel ratio control means, air-fuel ratio correction amount-changing means for increasing or decreasing the air-fuel ratio correction amount by a predetermined amount, based on the output from the second air-fuel ratio when the variation in the output from the second air-fuel ratio sensor falls within the predetermined small variation range, and determining means for determining that the second air-fuel ratio sensor is deteriorated when the variation in the output from the second air-fuel ratio sensor falls within the predetermined small variation range even after the air-fuel ratio correction amount is increased or decreased by the air-fuel ratio correction amount-changing means.

Preferably, the control parameter includes an integral term, and the air-fuel ratio correction amount-changing means of the deterioration-determining means increases or decreases the air-fuel ratio correction amount, based on the output from the second air-fuel ratio.

More preferably, the deterioration-determining means includes limiting means for calculating an average value of the air-fuel ratio correction amount before execution of the increasing or decreasing of the air-fuel ratio correction amount, and for limiting the air-fuel ratio correction amount after the execution of increasing or decreasing of the air-fuel ratio correction amount, to a predetermined range based on the calculated average value.

Also preferably, the sensor output variation-determining means of the deterioration-determining means continues the determination as to whether the variation in the output from the second air-fuel ratio sensor falls within the predetermined small variation range, at least over a predetermined time period which is sufficient for the output from the second air-fuel ratio sensor to vary within the predetermined time period after the increasing or decreasing of the air-fuel ratio correction amount is started when the second sensor is functioning normally.

Preferably, the air-fuel ratio control means sets the air-fuel ratio correction amount which has been increased or decreased by the air-fuel ratio correction amount-changing means to the average value calculated by the limiting means, upon completion of the determination as to deterioration of the second air-fuel ratio sensor by the deterioration-determining means.

In a preferred embodiment of the invention, the deterioration-determining means includes zone-determining means for determining which of a plurality of predetermined zones the output from the second air-fuel ratio sensor falls in, the air-fuel ratio correction amount-changing means of the deterioration-determining means executes increasing or decreasing the value of the air-fuel ratio correction amount, based on the output from the second air-fuel ratio sensor when the output from the second air-fuel ratio sensor continuously remains within one of the plurality of the predetermined zones over a predetermined time period.

Preferably, the determining means of the deterioration-determining means determines that the second air-fuel ratio sensor is deteriorated when the output from the second air-fuel ratio sensor continuously remains within one of the plurality of the predetermined zones over a second predetermined time period after the air-fuel ratio correction amount has been increased or decreased by the air-fuel ratio correction amount-changing means.

The above and other objects, features, and advantages of the invention will become more apparent from the following detailed description taken in conjunction with the accompanying drawings.

DETAILED DESCRIPTION

The invention will now be described in detail with reference to drawings showing an embodiment thereof.

Figure 1:
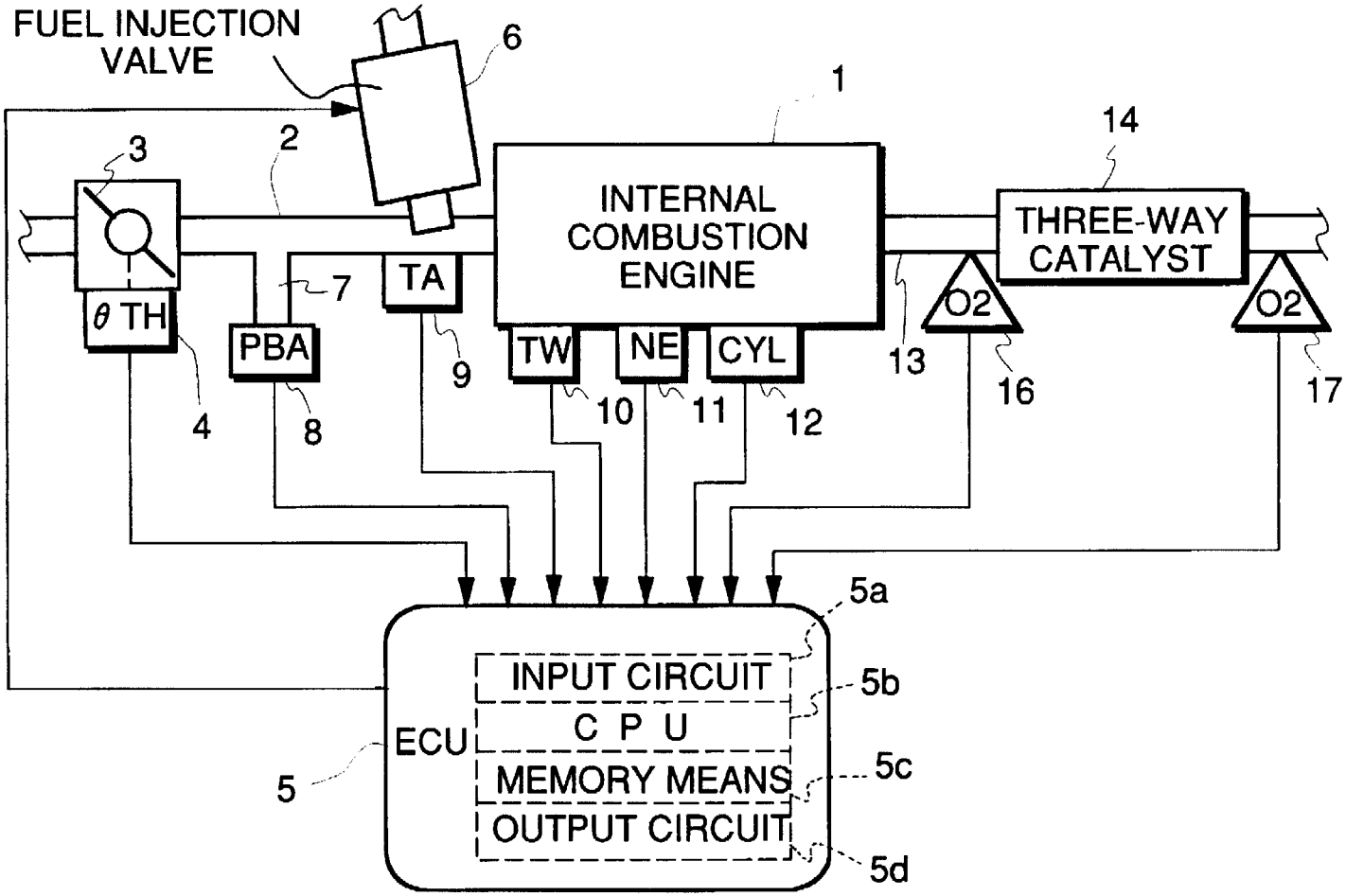
FIG. 1 is a block diagram showing the whole arrangement of an internal combustion engine and an air-fuel ratio sensor deterioration-detecting system therefor, according to an embodiment of the invention.

Referring first to FIG. 1, there is schematically shown the whole arrangement of an internal combustion engine and an air-fuel ratio sensor deterioration-detecting system therefor, according to an embodiment of the invention.

In the figure, reference numeral 1 designates an internal combustion engine (hereinafter referred to as "the engine"), which has an intake pipe 2 connected to the cylinder block thereof, across which is arranged a throttle valve 3. A throttle valve opening (θTH) sensor 4 is connected to the throttle valve 3 for generating an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location between the engine 1 and the throttle valve 3 and slightly upstream of an intake valve, not shown. Each fuel injection valve 6 is connected to a fuel pump, not shown, and electrically connected to the ECU 5 to have its valve opening period controlled by a signal therefrom.

On the other hand, an intake pipe absolute pressure (PBA) sensor 8 is connected to the intake pipe 2 via a conduit 7 at a location immediately downstream of the throttle valve 3 for sensing absolute pressure (PBA) within the intake pipe 2, and is electrically connected to the ECU 5 for supplying an electric signal indicative of the sensed absolute pressure PBA to the ECU 5. Further, an intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine which is filled with coolant, for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The NE sensor 11 generates a signal pulse (hereinafter referred to as "a TDC signal pulse") at each of predetermined crank angles whenever the crankshaft rotates through 180 degrees, while the CYL sensor 12 generates a signal pulse at a predetermined crank angle of a particular cylinder of the engine, both of the pulses being supplied to the ECU 5.

A three-way catalyst (catalytic converter) 14 is arranged in an exhaust pipe 13 connected to the engine 1, for purifying noxious components in exhaust gases from the engine, such as HC, CO, and NOx. Oxygen concentration sensors 16 and 17 are arranged in the exhaust pipe 13 at respective locations upstream and downstream of the three-way catalyst 13 (hereinafter referred to as "the upstream O2 sensor 16" and "the downstream O2 sensor 17"), for detecting the concentration of oxygen present in exhaust gases at their respective locations and supplying electric signals indicative of the sensed oxygen concentration to the ECU 5.

The ECU 5 is comprised of an input circuit 5*a* having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., and an output circuit 5*d* which delivers driving signals to the fuel injection valves 6.

The CPU 5*b* operates in response to the above-mentioned signals from the sensors to determine operating conditions in which the engine 1 is operating, such as an air-fuel ratio feedback control region in which air-fuel ratio feedback control is carried out in response to the concentration of oxygen in exhaust gases and air-fuel ratio open-loop control regions, and calculates, based upon the determined, engine operating conditions, the valve opening period or fuel injection period TOUT over which the fuel injection valves 6 are to be opened, by the use of the following equation (1), in synchronism with generation of TDC signal pulses:

$$TOUT=Ti\times KO2\times K1+K2 \quad (1)$$

where Ti represents a basic value of the fuel injection period, which is determined according to the engine rotational speed NE and the intake pipe absolute pressure PBA. A map for determining the Ti value is stored in the memory means 5c.

KO2 represents an air-fuel ratio correction coefficient which is determined based on outputs from the upstream and downstream O2 sensors 16 and 17 when the engine 1 is operating in the air-fuel ratio feedback control region, while it is set to predetermined values corresponding to the respective air-fuel ratio open-loop control regions of the engine when the engine 1 is in the open-loop control regions.

K1 and K2 represent other correction coefficients and correction variables, respectively, which are set according to engine operating parameters to such values as optimize operating characteristics of the engine, such as fuel consumption and engine accelerability.

The CPU 5b supplies driving signals via the output circuit 5d to the fuel injection valves 6, based on the fuel injection period TOUT thus determined, to drive the fuel injection valves 6.

Figure 2A:
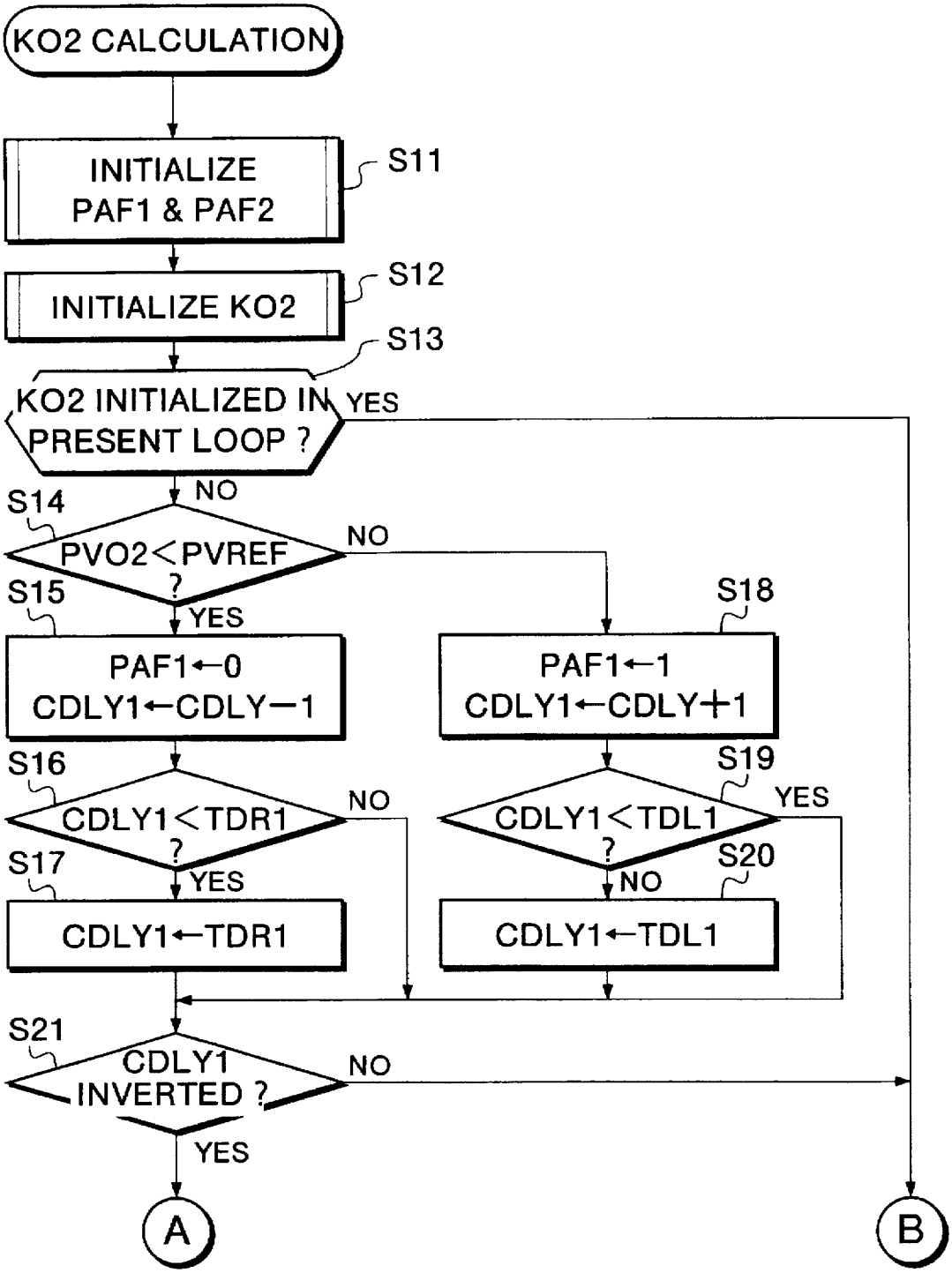
FIG. 2A is a flowchart showing a program for carrying out air-fuel ratio feedback control based on outputs from downstream and upstream O2 sensors by calculating an air-fuel ratio correction coefficient KO2 during air-fuel ratio feedback control.
Figure 2B:
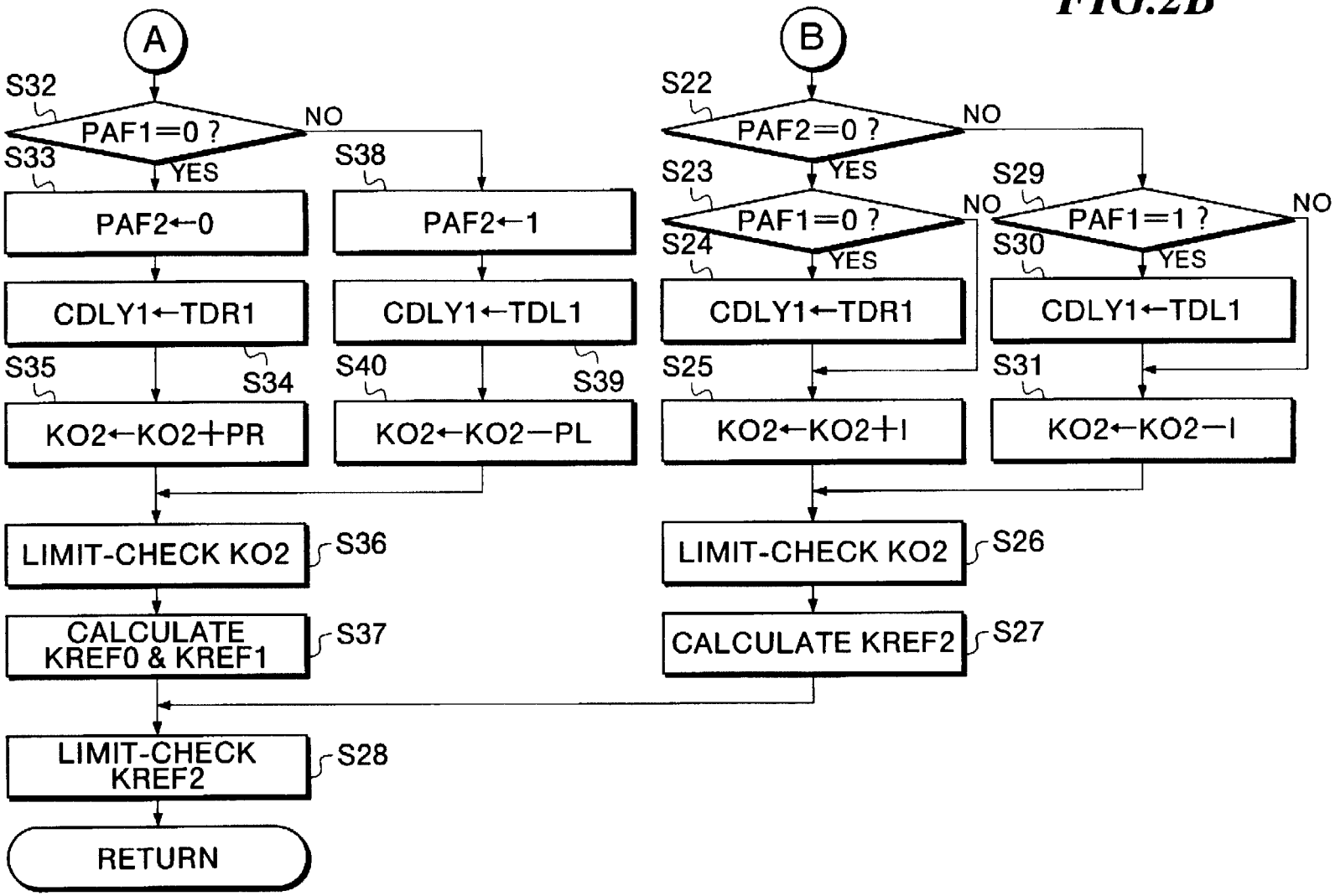
FIG. 2B is a continued part of the FIG. 2A flowchart.

FIG. 2A and FIG. 2B show a program for carrying out air-fuel ratio feedback control based on outputs from the upstream and downstream O2 sensors (hereinafter referred to as ordinary F/B control), in which the air-fuel ratio correction coefficient KO2 is calculated based on the outputs from the upstream and downstream O2 sensors. According to this program, the air-fuel ratio correction coefficient KO2 is calculated based on output voltage PVO2 from the upstream O2 sensor 16 and output voltage SVO2 from the downstream O2 sensor 17 such that the air-fuel ratio of an air-fuel mixture supplied to the engine becomes equal to a stoichiometric value ($\lambda$=1). This program is executed by the CPU 5b at predetermined fixed time intervals (e.g. 5 msec) when the engine is operating in the air-fuel ratio feedback control region.

First, at a step S11, flags PAF1 and PAF2 are initialized. The flag PAF1 indicates lean and rich states of the output voltage PVO2 from the upstream O2 sensor 16, when set to "0" and "1", respectively, and the flag PAF2 indicates lean and rich states of the same after a predetermined delay time has been counted up by a counter CDLY1, referred to hereinafter, when set to "0" and "1", respectively. Then, at a step S12, the air-fuel ratio correction coefficient KO2 is initialized (e.g. set to an average value KREFi (i=0–2) thereof), followed by the program proceeding to a step S13.

At the step S13, it is determined whether or not the air-fuel ratio correction coefficient KO2 has just been initialized in the present loop. If the answer is negative (NO), the program proceeds to a step S14, wherein it is determined whether or not the upstream O2 sensor output voltage PVO2 is lower than a reference value PVREF (threshold value for determining whether the output voltage PVO2 is rich or lean). If the answer is affirmative (YES), i.e. if PVO2<PVREF, it is determined that the output voltage PVO2 from the upstream O2 sensor 16 shows a lean value, and then the flag PAF1 is set to "0" at a step S15, and at the same time the count value CDLY of the counter CDLY1 (set value: CDLY1) for counting a P-term generation delay time TDR1 or TDL1 is decremented by 1. More specifically, if PVO2<PVREF holds, the flag PAF1 is set to "0" and the count value CDLY of the counter CDLY1 is decremented by 1 to thereby obtain the set value CDLY1 whenever the step S15 is executed.

Then, at a step S16, it is determined whether or not the set value CDLY1 is smaller than the predetermined delay time TDR1. If the answer is affirmative (YES), i.e. if CDLY1<TDR1 holds, the set value CDLY1 is reset to the delay time TDR1 at a step S17. On the other hand, if the answer to the question of the step S14 is negative (NO), i.e. if PVO2≧PVREF holds, which means that the output voltage PVO2 from the upstream O2 sensor 16 shows a rich value, the flag PAF1 is set to "1", and at the same time the count value CDLY is incremented by 1 at a step S18. More specifically, if PVO2≧PVREF holds, the flag PAF1 is set to "1"and the count value CDLY of the counter CDLY1 is incremented by 1 to thereby obtain the set value CDLY1 whenever the step S18 is carried out.

Then, at a step S19, it is determined whether or not the set value CDLY1 is smaller than the predetermined delay time TDL1. If the answer is negative (NO), i.e. if CDLY1≧TDL1 holds, the set value CDLY1 is reset to the delay time TDL1 at a step S20. If the answer to the question of the step S16 is negative (NO), i.e. if CDLY1≧TDR1 holds, the program skips over the step S17 to a step S21. Similarly, if the answer to the question at the step S19 is affirmative (YES), i.e. if CDLY1<TDL1 holds, the program skips over the step S20 to the step S21.

At the step S21, it is determined whether or not the sign of the count value CDLY1 has been inverted. That is, it is determined whether or not the delay time TDR1 or TDL1 has been counted up after the output voltage PVO2 from the upstream O2 sensor 16 crossed the reference value PVREF. If the answer is negative (NO), i.e. if the delay time TDR1 or TDL1 has not elapsed, the program proceeds to a step S22, wherein it is determined whether or not the flag PAF2 has been set to "0". If the answer is affirmative (YES), it is determined at a step S23 whether or not the flag PAF1 has been set to "0". If the answer is affirmative (YES), it is judged that the air-fuel ratio has continuously been lean, so that the program proceeds to a step S24, wherein the set value CDLY1 is reset to the delay time TDR1, followed by the program proceeding to a step S25. On the other hand, if the answer to the question of the step S23 is negative (NO), it is judged that the delay time period has not elapsed yet after the output voltage PVO2 from the upstream O2 sensor 16 was inverted from a lean side to a rich side, i.e. after it crossed the reference value PVREF, so that the program skips over the step S24 to the step S25.

At the step S25, a present value of the air-fuel ratio correction coefficient KO2 is calculated by adding an integral term I to a value of the coefficient KO2 calculated in the immediately preceding loop, by the use of the following equation (2):

$$KO2=KO2+I \tag{2}$$

where KO2 on the right side represents the immediately preceding value of the air-fuel ratio correction coefficient KO2, and I a correction term (integral term: control parameter) applied for increasing or decreasing the KO2 value so as to make the air-fuel ratio of the mixture equal to the stoichiometric air-fuel ratio when the delay time period TDL1 or TDR1 has not elapsed after inversion of the output voltage PVO2 from the upstream O2 sensor 16.

After execution of the step S25, limit-checking of the resulting value of the correction coefficient KO2 is performed in a known manner at a step S26, and then a value KREF2 (learned value of the correction coefficient KO2 to be applied in starting the vehicle) is calculated at a step S27, followed by executing limit-checking of the resulting value KREF2 at a step S28. Thus, the present program is terminated.

On the other hand, if the answer to the question of the step S22 is negative (NO), i.e. if the flag PAF2 has been set to "1", it is further determined at a step S29 whether or not the flag PAF1 has been set to "1". If the answer is affirmative (YES), it is judged that the air-fuel ratio has continuously been rich, and then at a step S30, the set value CDLY1 is reset to the delay time TDL1 again, followed by the program proceeding to a step S31. On the other hand, if the answer to the question of the step S29 is negative (NO), it is judged that the delay time period has not elapsed yet after the output voltage PVO2 from the upstream O2 sensor 16 was inverted from the lean side to the rich side, so that the program skips over the step S30 to a step S31.

At the step S31, a present value of the correction coefficient KO2 is calculated by subtracting the integral term I from the immediately preceding value of the correction coefficient KO2, by the use of the following equation (3):

$$KO2=KO2-I \quad (3)$$

Then, the above steps S26 to S28 are carried out, followed by terminating the routine.

In this way, when the sign of the set value CDLY1 has not been inverted, the statuses of the flags PAF1 and PAF2 are checked to determine whether or not the output voltage PVO2 from the upstream O2 sensor 16 has been inverted from the lean side to the rich side or vice versa, and a final value of the correction coefficient KO2 is calculated based on results of the checking.

On the other hand, if it is determined at the step S21 that the sign of the count value of the counter CDLY1 has been inverted, i.e. if the answer to the question of the step S21 is affirmative (YES), that is, if the delay time TDR1 or the delay time TDL1 has elapsed after the output voltage PVO2 from the upstream O2 sensor 16 was inverted from the lean side to the rich side or vice versa, the program proceeds to a step S32, wherein it is determined whether or not the flag PAF1 has been set to "0", i.e. whether or not the output voltage PVO2 from the upstream O2 sensor 16 shows a lean value. If the answer is affirmative (YES), i.e. if PAF1=0 holds (the output voltage PVO2 shows a lean value), the program proceeds to a step S33.

At the step S33, the flag PAF2 is set to "0", and then at a step S34, the set value CDLY1 is reset to the delay time TDR1, followed by the program proceeding to a step S35.

At the step S35, a present value of the correction coefficient KO2 is calculated by adding a proportional term PR to the immediately preceding value of the correction coefficient KO2 by the use of the following equation (4):

$$KO2=KO2+PR \quad (4)$$

where PR represents a correction value (control parameter) applied for stepwise increasing the correction coefficient KO2 when the delay time period TDL1 has elapsed after inversion of the output voltage PVO2 from the upstream O2 sensor 16 from the rich side to the lean side with respect to the stoichiometric air-fuel ratio. This PR value is changed according to the output voltage from the downstream O2 sensor 17 as described hereinafter.

Then, limit-checking of the correction coefficient KO2 calculated as above is carried out at a step S36, and a value KREF0 (average value of the correction coefficient KO2 calculated during idling of the engine) and a value KREF1 (average value of the correction coefficient KO2 calculated when the engine is not idling) are calculated at a step S37. Then, the program proceeds to the step S28, followed by terminating the program.

If the answer to the question of the step S32 is negative (NO), i.e. if the output voltage PVO2 from the upstream O2 sensor 16 shows a rich value (PAF1=1), the program proceeds to a step S38, wherein the flag PAF2 is set to "1", and then at a step S39, the set value CDLY1 is reset to the delay time TDL1, followed by the program proceeding to a step S40.

At the step S40, a present value of the correction coefficient KO2 is calculated by subtracting a proportional term PL from the immediately preceding value of the correction coefficient KO2 by the use of the following equation (5):

$$KO2=KO2-PL \quad (5)$$

where PL represents a correction value (control parameter) applied for stepwise decreasing the correction coefficient KO2 when the delay time period TDL1 has elapsed after inversion of the output voltage PVO2 from the upstream O2 sensor 16 from the lean side to the rich side with respect to the stoichiometric air-fuel ratio. This PL value is changed according to the output voltage from the downstream O2 sensor 17 as described hereinafter.

Then, the steps S36, S37 and S28 are sequentially carried out, followed by terminating the program. In this way, the timing of generation of the integral term I and the proportional term PR or PL of the correction coefficient KO2 is calculated based on the output voltage PVO2 from the upstream O2 sensor 16.

Figure 3:
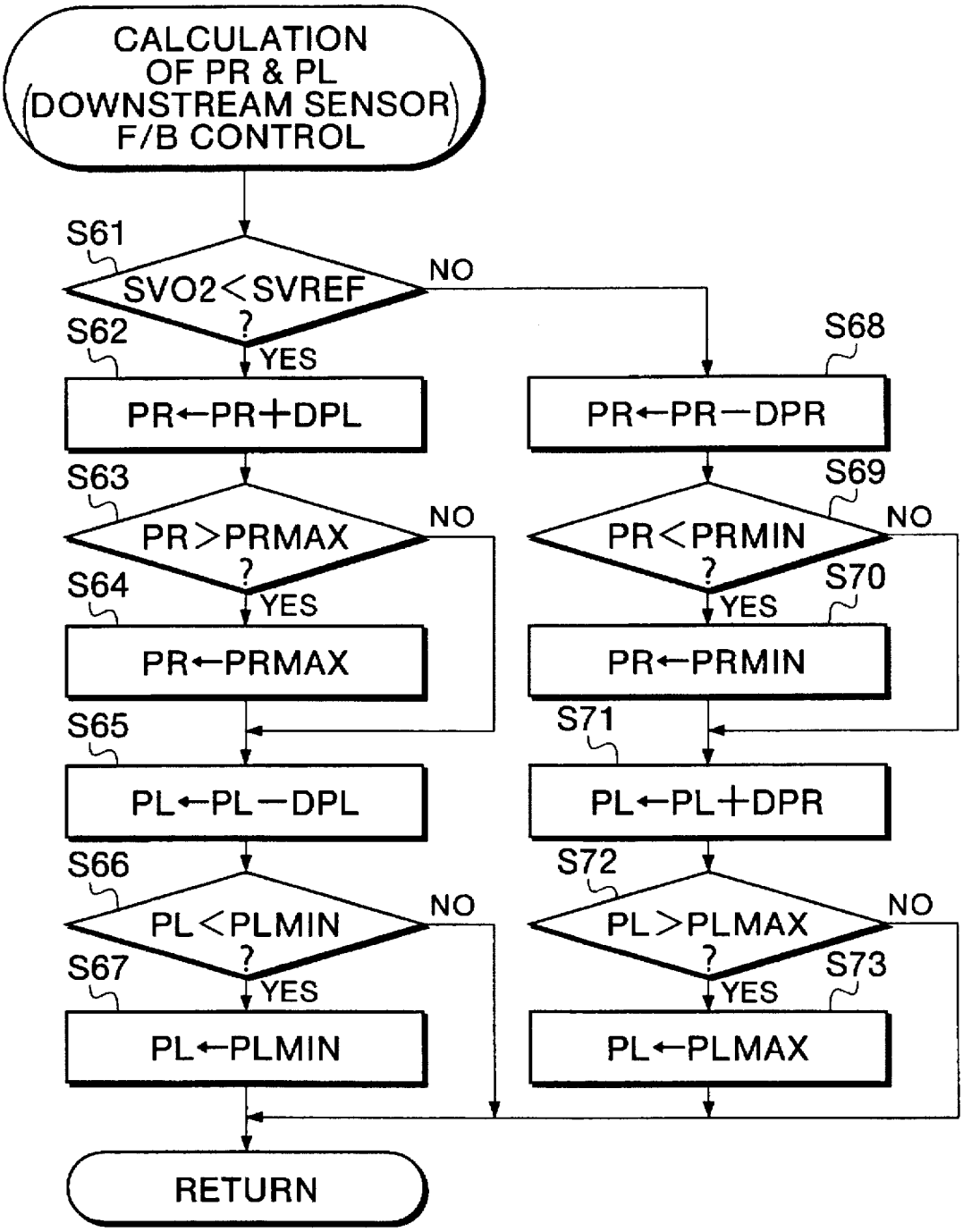
FIG. 3 is a flowchart showing a program for carrying out air-fuel ratio feedback control based on the output from the downstream O2 sensor.

FIG. 3 shows a program for carrying out air-fuel ratio feedback control based on the output from the downstream O2 sensor by calculating the proportional terms PL and PR which are employed at the step S35 and S40 in FIG. 2B, in response to the output voltage SVO2 from the downstream O2 sensor 17. This program is executed by the CPU 5*b* at predetermined fixed time intervals (e.g. 5 msec) when the engine is operating in the air-fuel ratio feedback control region for carrying out the air-fuel ratio feedback control based on the downstream O2 sensor output SVO2.

Basically, the PR and PL values are calculated based on the output voltage SVO2 from the downstream O2 sensor 17 (air-fuel ratio feedback control based on the downstream O2 sensor). However, when the feedback control based on the downstream O2 sensor output cannot be executed (e.g. during idling of the engine, when the downstream O2 sensor 17 is inactive, etc.), predetermined values or the learned values calculated during the feedback control are applied as the PR and PL values.

At a step S61, it is determined whether or not the downstream O2 sensor output voltage SVO2 is lower than a reference value SVREF (e.g. 0.45 V). If SVO2<SVREF holds, the program proceeds to a step S62, wherein a correction term DPL applied when the air-fuel ratio is determined to be lean is added to the PR value. If the PR value after the addition exceeds an upper limit value PRMAX at a step S63, the PR value is set to the upper limit value PRMAX at a step S64. At the following step S65, the correction term DPL is subtracted from the PL value. If the PL value after the subtraction is smaller than a lower limit value PLMIN at a step S66, the PL value is set to the lower limit value PLMIN at a step S67.

On the other hand, if the answer to the question of the step S61 is negative (NO), i.e. if SVO2≧SVREF holds, the program proceeds to a step S68, wherein a correction term DPR applied when the air-fuel ratio is determined to be rich is subtracted from the PR value. If it is determined at a step S69 that the PR value after the subtraction is smaller than a lower limit value PRMIN, the PR value is set to the lower limit value PRMIN at a step S70. Then, at a step S71, the correction term DPR is added to the PL value. If it is determined at a step S72 that the PL value after the addition is larger than an upper limit value PLMAX, the PL value is set to the upper limit value PLMAX at a step S73.

According to the above processing, during a time period over which SVO2<SVREF holds, the PR value is increased within a range between the lower and upper limit values PRMIN and PRMAX, while the PL value is decreased within a range between the lower and upper limit values PLMIN and PLMAX. On the other hand, during a time period over which SVO2≧SVREF holds, the PR value is decreased and the PL value is increased within the above-mentioned respective ranges.

Figure 4:
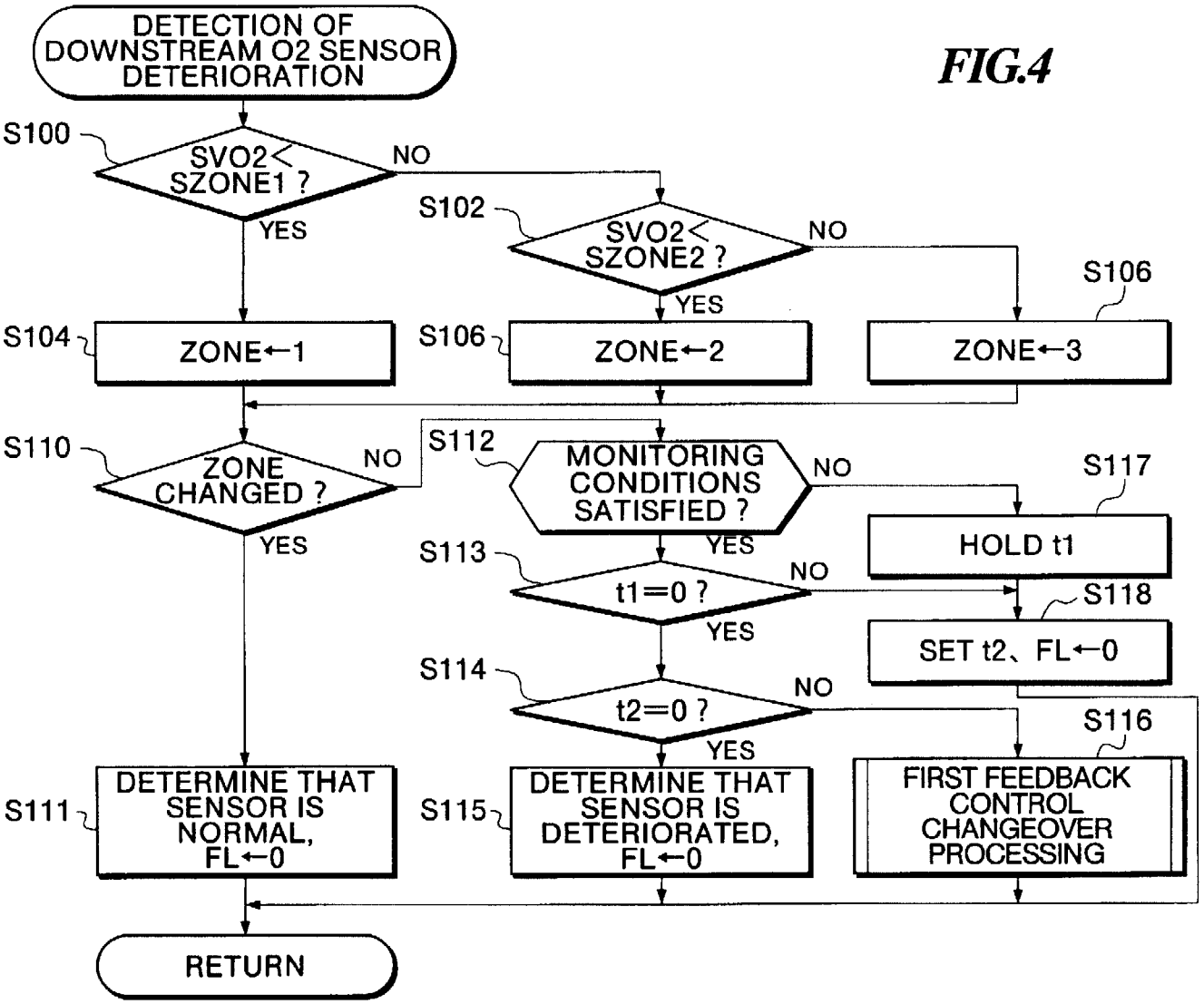
FIG. 4 is a flowchart showing a program for detecting deterioration of the downstream O2 sensor.

FIG. 4 shows a program for detecting deterioration of the downstream O2 sensor 17, which is executed by the CPU 5b in synchronism with execution of the program of FIGS. 2A and 2B, etc.

First, at a step S100, it is determined whether or not the downstream O2 sensor output SVO2 is smaller than a first zone reference value SZONE1 (e.g. 0.4 V), and if SVO2≧SZONE1 holds, it is determined at a step S102 whether or not the downstream O2 sensor output SVO2 is smaller than a second zone reference value SZONE2 (e.g. 0.6 V). If it is determined that SVO2<SZONE1 holds, a zone parameter ZONE indicating a range in which the SVO2 value falls is set to "1" at a step S104. On the other hand, if it is determined that SZONE1≦SVO2<SZONE2 holds, the zone parameter ZONE is set to "2" at a step S106, while if SVO2≧SZONE2 holds, the zone parameter ZONE is set to "3" at a step S108.

At the following step S110, it is determined whether or not the value of the zone parameter ZONE has been changed. If it has been changed, that is, if the output voltage SVO2 from the downstream O2 sensor 17 has moved between at least two of the three zones ZONE1 to ZONE3, the program proceeds to a step S111, wherein it is determined that the downstream O2 sensor 17 is functioning normally, and a flag FL, referred to hereinafter, is set to "0", followed by terminating the present program.

On the other hand, if it is determined at the step S110 that the value of the zone parameter ZONE has not been changed, that is, if the output voltage SVO2 from the downstream O2 sensor 17 has not moved between at least two of the three zones ZONE1 to ZONE3, basically it is determined that the downstream O2 sensor 17 is deteriorated. However, the output voltage SVO2 from the sensor 17 can remain unchanged even if the sensor is functioning normally, which leads to an erroneous determination that the sensor is deteriorated. To avoid this, the following procedure is executed before finally determining whether or not the sensor is deteriorated:

If it is determined at the step S110 that there has been no change in the value of the zone parameter ZONE, the program proceeds to a step S112, wherein it is determined whether or not monitoring conditions for the downstream O2 sensor 17 for determining deterioration thereof are satisfied. More specifically, it is determined whether or not values of operating parameters of the engine 1, such as the engine rotational speed, load on the engine (e.g. PBA), the engine coolant temperature and the intake air temperature, fall within respective predetermined ranges, that is, whether or not the engine 1 is operating in a stable operating condition. If it is determined at the step S112 that the monitoring conditions are satisfied, the program proceeds to a step S113, wherein it is determined whether or nor a predetermined time period t1 has elapsed. The predetermined time period t1 is set to such a time period that if the output voltage SVO2 from the downstream O2 sensor 17 has not moved between the zones ZONE1 to ZONE 3 over the time period t1, it is provisionally determined that the sensor is deteriorated. The predetermined time period t1 is set upon start of the engine 1, and counted only during satisfaction of the monitoring conditions for the downstream O2 sensor 17 (when the answer to the question of the step S112 is affirmative (YES)).

On the other hand, if it is determined at the step S112 that the monitoring conditions for the downstream O2 sensor 17 are not satisfied, the predetermined time period t1 is held at its immediately preceding value, and a predetermined time period t2 at a step S117, hereinafter referred to, is set to a counter thereof and the flag FL is set to "0" at a step S118, followed by terminating the program. The flag FL indicates, when set to "1", satisfaction of a condition for changing over feedback control mode from the ordinary F/B control, described hereinbefore with reference to FIGS. 2A and 2B, to monitoring O2 sensor output-based air-fuel ratio feedback control, hereinafter described.

If it is determined at the step S113 that the predetermined time period t1 has not elapsed, the step S118 is executed, followed by terminating the program.

If it is determined at the step S113 that the predetermined time period t1 has elapsed, the program proceeds to a step S114, wherein it is determined whether or not the predetermined time period t2 has elapsed. If the time period t2 has elapsed, the program proceeds to a step S115 to determine that the downstream O2 sensor 17 is deteriorated, and the flag FL is set to "0", followed by terminating the program.

On the other hand, if it is determined at the step S114 that the predetermined time period t2 has not elapsed, the program proceeds to a step S116 to execute first feedback control changeover processing, described hereinbelow, followed by terminating the program.

Figure 5:
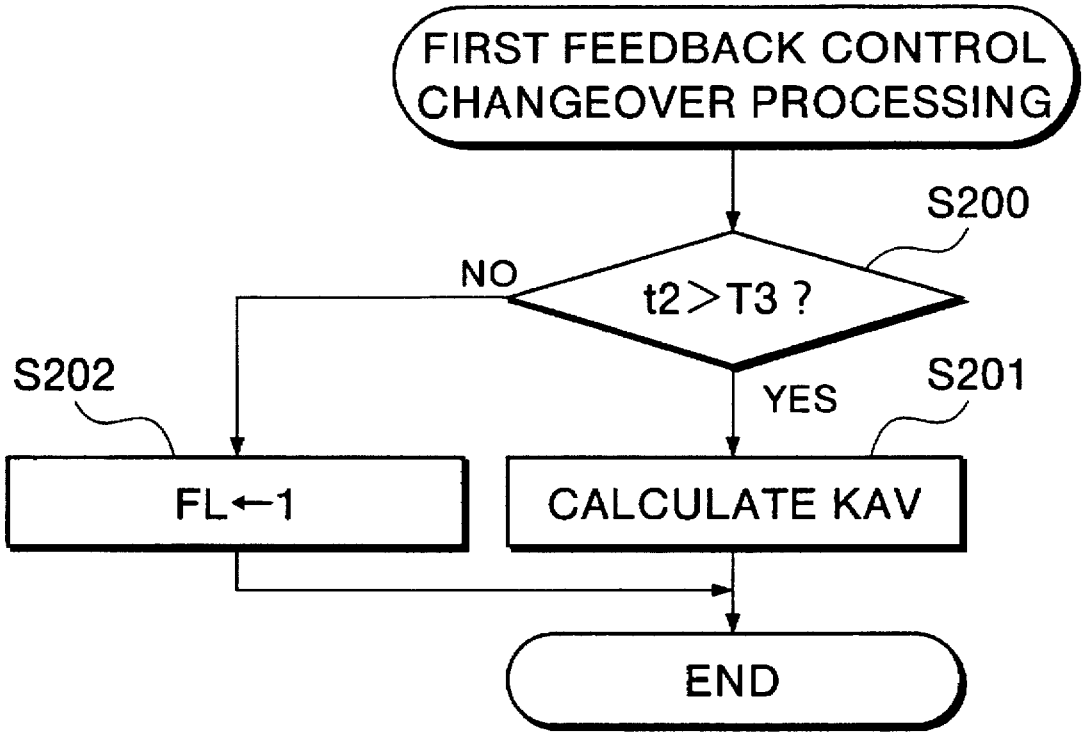
FIG. 5 is a flowchart showing a program for carrying out first feedback control changeover processing.

FIG. 5 shows a flowchart for carrying out the first feedback control changeover processing.

First, at a step S200, it is determined whether or not a residual count time in the counter for down-counting the predetermined time period t2 exceeds a predetermined time period T3. If t2>T3 holds, the program proceeds to a step S201, wherein an average value KAV of the air-fuel ratio correction coefficient KO2 is calculated in a known manner, followed by terminating the program. The calculation of the average value KAV is carried out so long as t2>T3 holds, i.e. over a time period (t2–T3) (e.g. 5 sec). The predetermined time period T3 is a time period over which the monitoring O2 sensor output-based feedback control, described later, is to be carried out, and set to a time period as long as a time period from the time a change occurs in the air-fuel ratio of the mixture supplied to the engine 1 to the time a corresponding change actually occurs in the output voltage SVO2 from the downstream O2 sensor 17 downstream of the three-way catalyst 14. Therefore, the setting of the predetermined time period T3 is made in dependence on the volume of exhaust gases in the exhaust pipe 13 assumed when the engine is in a region where detection of deterioration of the downstream O2 sensor 17 is carried out, the capacity of the three-way catalyst 14, etc. The predetermined time periods t2 and T3 may be counted by a common counter to reduce the capacity of a RAM which stores the counted time periods.

The ground for calculating the average value KAV of the air-fuel ratio correction coefficient KO2 at the step S201 will be described hereinafter.

On the other hand, if t2>T3 does not hold at the step S200, the flag FL is set to "1" at a step S202, followed by terminating the program.

Figure 6:
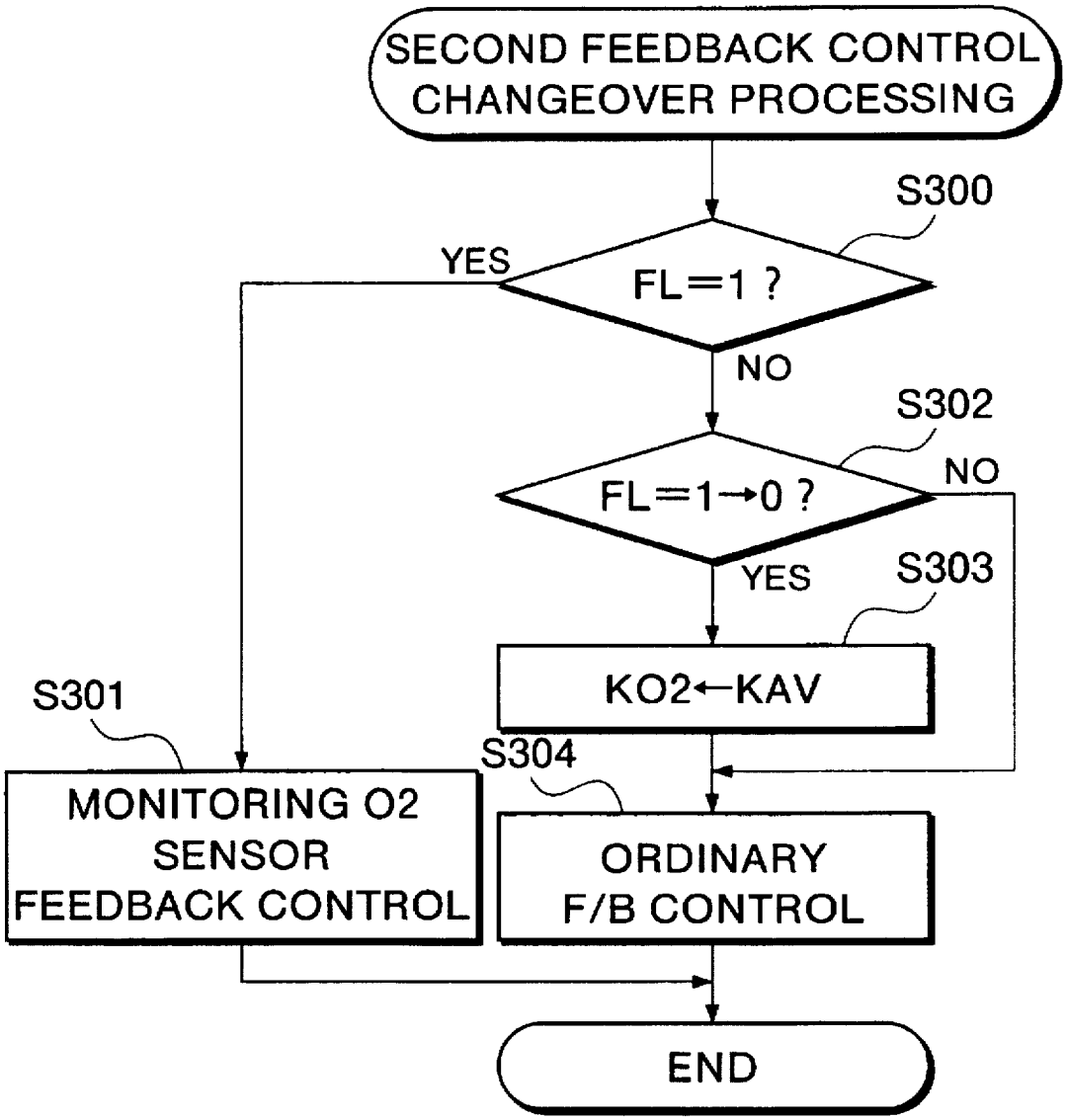
FIG. 6 is a flowchart showing a program for carrying out second feedback control changeover processing.

Next, second feedback control changeover processing will be described with reference to FIG. 6 showing a program for carrying out the same processing. This processing is executed by the CPU 5 in synchronism with the processing of FIG. 6.

First, at a step S300, it is determined whether or not the flag FL assumes "1". If it assumes "1", that is, if the condition for changing over the feedback control mode is satisfied, the program proceeds to a step S301, wherein the monitoring O2 sensor output-based air-fuel ratio feedback control is executed, as hereinafter described, followed by terminating the program.

On the other hand, if it is determined at the step S300 that the flag FL does not assume "1", the program proceeds to a step S302 to determine whether or not the present loop of this program is the first loop after an inversion of the flag FL from "1" to "0". If the answer is affirmative (YES), the air-fuel ratio correction coefficient KO2 is set to the average value KAV thereof calculated at the step S201 in FIG. 5, to thereby initialize the KO2 value, at a step S303. Then, at a step S304, the ordinary F/B control is executed in the manner described hereinbefore with reference to FIGS. 2A and 2B, followed by terminating the program. On the other hand, if the present loop is not the first loop after an inversion of the flag FL from "1" to "0", the program skips over the step S303 to the step S304 to execute the ordinary F/B control, followed by terminating the program.

Figure 7:
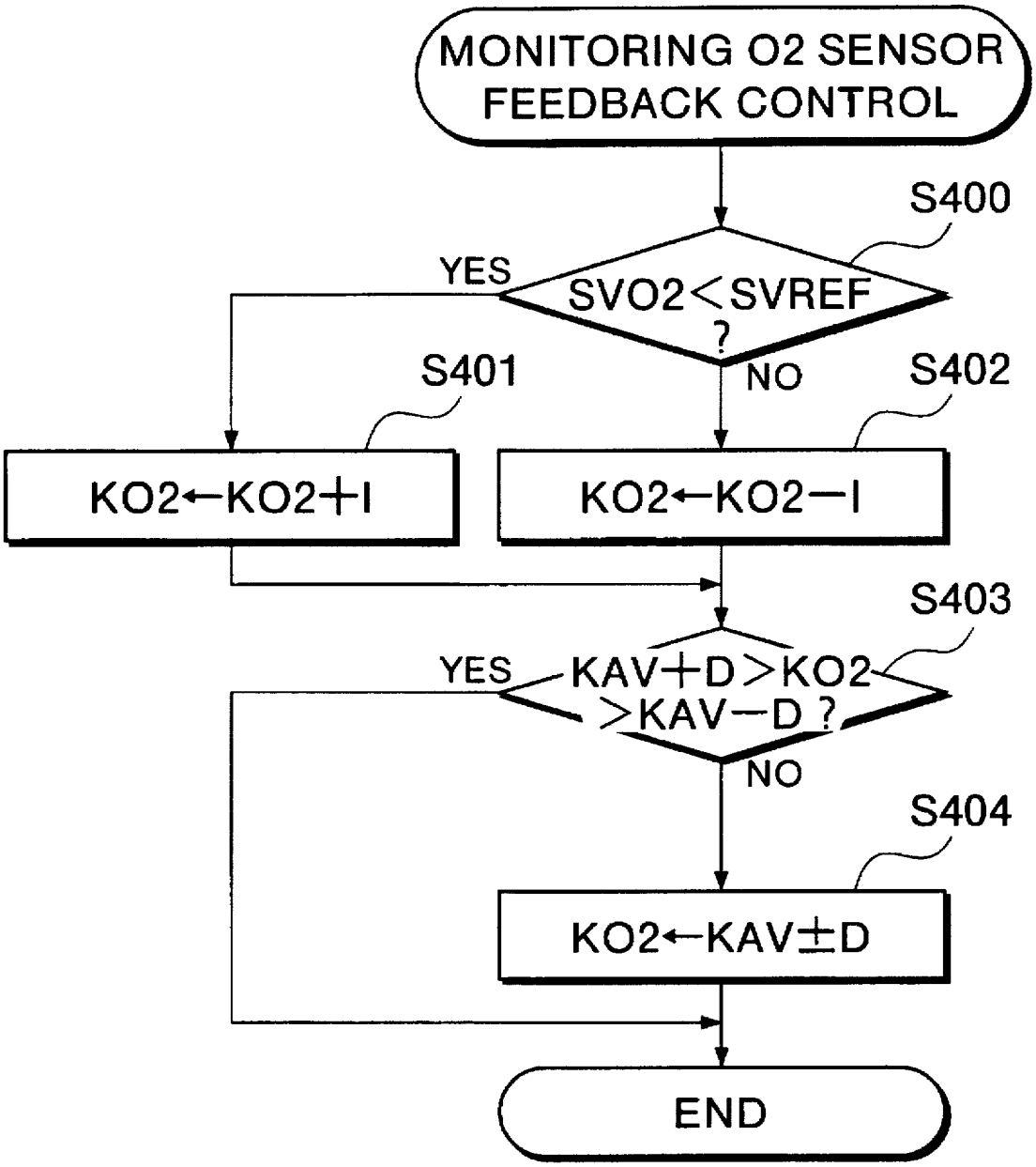
FIG. 7 is a flowchart showing a program for carrying out air-fuel ratio feedback control based on the output from the upstream O2 sensor for monitoring the O2 sensor output.

Next, the monitoring O2 sensor output-based air-fuel ratio feedback control executed at the step S301 in FIG. 6 will be described with reference to FIG. 7 showing a program for carrying the same processing. This program is executed at predetermined time periods (e.g. 5 msec) over a time period during which the flag FL assumes "1", that is, over the predetermined time period T3 (e.g. 7 sec).

First, at a step S400, it is determined whether the output voltage SVO2 shows a lean value (SVO2<SVREF). If SVO2<SVREF holds, the program proceeds to a step S401, wherein the integral term I is added to a value of the KO2 value calculated in the immediately preceding loop to obtain a present value of the KO2 value. On the other hand, if SVO2≧SVREF holds, the program proceeds to a step S402, wherein the integral term I is subtracted from the value of the KO2 value calculated in the immediately preceding loop to obtain a present value of the KO2 value. By thus adding or subtract the integral term I to or from the KO2 value, the control air-fuel ratio can be varied. After execution of the step S401 or S402, limit-checking of the KO2 value thus calculated is effected. Specifically, if KAV+D>KO2>KAV−D does not hold, the KO2 value is set to KAV+D or KAV−D (steps S403 or S404), followed by terminating the program. D represents a variation width of the air-fuel ratio required for detection of deterioration of the downstream O2 sensor, which is determined in dependence on the volume of exhaust gases in the downstream O2 sensor deterioration-detecting region of the engine, the capacity of the three-way catalyst 14, etc.

Figure 8:
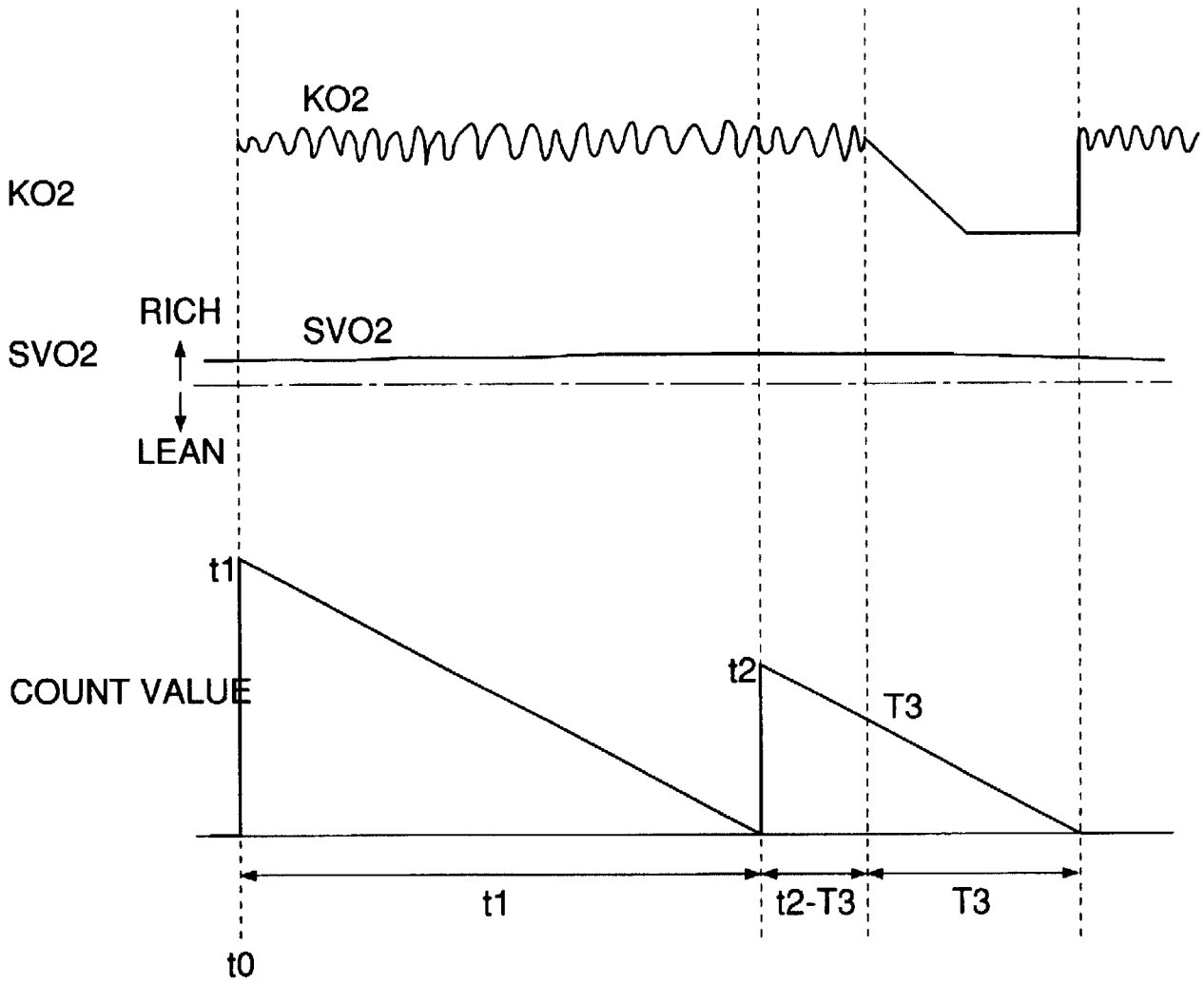
FIG. 8 is a diagram useful in explaining the manner of the detection of deterioration of the upstream O2 sensor according to the embodiment.

Next, an example of the processing of FIGS. 4 to 7 will be explained with reference to FIG. 8.

First, at a time point t0 when the engine 1 is started, the predetermined time period t1 used to provisionally determine whether the downstream O2 sensor 17 is deteriorated when the output SVO2 from the sensor has not moved between the zones ZONE 1 to ZONE3 is set to "1". This predetermined time period t1 is allowed to elapse and counted only during the time the monitoring conditions are satisfied. Time periods over which the monitoring conditions are satisfied while the ordinary F/B control is being carried out (step S112), and at the same time the output voltage SVO2 from the downstream O2 sensor 17 remains unchanged are accumulated, and it is determined whether or not the total accumulated time period reaches the predetermined time period t1 (step S113). In the illustrated example, after the predetermined time period t1 has elapsed from the time point t0 with the sensor output voltage SVO2 remaining unchanged, the average value KAV of the air-fuel ratio correction coefficient KO2 is calculated over the predetermined time period (t2–T3) (steps S200–S201). After calculation of the average value KAV, the first and second feedback control changeover processings are executed (step S200→S202, and S300→S301), and then the monitoring O2 sensor output-based feedback control is executed over the predetermined time period T3 to thereby impart a variation to the controlled air-fuel ratio (step S400→S401 and S402→S403→S404).

If the output voltage SVO2 from the downstream O2 sensor 17 changes during the execution of the monitoring O2 sensor output-based feedback control over the predetermined time period T3, a decision that the downstream O2 sensor 17 is functioning normally is rendered (step S110→S111), while if the output voltage SVO2 changes, a decision that the sensor 17 is deteriorated is rendered (step S110→S112→S113→S114→S115).

The calculation of the average value KAV of the air-fuel ratio correction coefficient KO2 at the step S201 is performed in order to limit the maximum variable range of the air-fuel ratio correction coefficient KO2 over the predetermined time period T3 within the range of KAV±D and hence minimize the influence of the variation of the air-fuel ratio correction coefficient KO2 at the steps S400 to S402 upon the exhaust emission characteristics of the engine and the driveability.

Further, the air-fuel ratio correction coefficient KO2 is initialized by setting the same to the average value KAV upon termination of the monitoring O2 sensor output-based feedback control (step S303) to return the controlled air-fuel ratio from the enlarged variation width imparted by the relatively large value D to a normal variation width to thereby minimize the influence of the variation of the air-fuel ratio correction coefficient KO2 upon the exhaust emission characteristics and the driveability.

As described above, according to the present embodiment, by increasing or decreasing the air-fuel ratio correction coefficient KO2 by the integral term I within the range of KAV±D during the monitoring O2 sensor output-based feedback control, a sufficient amount of variation in the air-fuel ratio for causing an appreciable amount of change in the output from the downstream O2 sensor when it is functioning normally to thereby enable accurate determination of deterioration of the downstream O2 sensor.

What is claimed is:

1. In an air-fuel ratio sensor deterioration-detecting system for an internal combustion engine having an exhaust system, a catalytic converter arranged in said exhaust system, first and second air-fuel ratio sensors arranged in said exhaust system at respective locations upstream and downstream of said catalytic converter, air-fuel ratio control parameter-calculating means for calculating a value of a control parameter, based on an output from said second air-fuel ratio sensor, air-fuel ratio correction amount-calculating means for calculating an air-fuel ratio correction amount, based on an output from said first air-fuel ratio sensor and the calculated value of said control parameter, air-fuel ratio control means for executing air-fuel ratio feedback control in a manner such that an air-fuel ratio of an air-fuel mixture to be supplied to said engine is controlled based on the calculated air-fuel ratio correction amount, and deterioration-determining means for determining whether said second air-fuel ratio sensor is deteriorated, based on said output from said second air-fuel ratio sensor, the improvement wherein:

said deterioration-determining means comprises sensor output variation-determining means for determining whether a variation in said output from said second air-fuel ratio sensor falls within a predetermined small variation range during execution of said air-fuel ratio feedback control by said air-fuel ratio control means, air-fuel ratio correction amount-changing means for increasing or decreasing said air-fuel ratio correction amount by a predetermined amount, based on said output from said second air-fuel ratio when said variation in said output from said second air-fuel ratio sensor falls within said predetermined small variation range, and determining means for determining that said second air-fuel ratio sensor is deteriorated when said variation in said output from said second air-fuel ratio sensor falls within said predetermined small variation range even after said air-fuel ratio correction amount is increased or decreased by said air-fuel ratio correction amount-changing means.

2. An air-fuel ratio sensor deterioration-detecting system as claimed in claim 1, wherein said control parameter includes an integral term, and said air-fuel ratio correction amount-changing means of said deterioration-determining means increases or decreases said air-fuel ratio correction amount, based on said output from said second air-fuel ratio.

3. An air-fuel ratio sensor deterioration-detecting system as claimed in claim 1, wherein said deterioration-determining means includes limiting means for calculating an average value of said air-fuel ratio correction amount before execution of said increasing or decreasing of said air-fuel ratio correction amount, and for limiting said air-fuel ratio correction amount after said execution of increasing or decreasing of said air-fuel ratio correction amount, to a predetermined range based on the calculated average value.

4. An air-fuel ratio sensor deterioration-detecting system as claimed in claim 1, wherein said sensor output variation-determining means of said deterioration-determining means continues said determination as to whether said variation in said output from said second air-fuel ratio sensor falls within said predetermined small variation range, at least over a predetermined time period which is sufficient for said output from said second air-fuel ratio sensor to vary within said predetermined time period after said increasing or decreasing of said air-fuel ratio correction amount is started when said second sensor is functioning normally.

5. An air-fuel ratio sensor deterioration-detecting system as claimed in claim 3, wherein said air-fuel ratio control means sets said air-fuel ratio correction amount which has been increased or decreased by said air-fuel ratio correction amount-changing means to said average value calculated by said limiting means, upon completion of the determination as to deterioration of said second air-fuel ratio sensor by said deterioration-determining means.

6. An air-fuel ratio sensor deterioration-detecting system as claimed in claim 1, wherein said deterioration-determining means includes zone-determining means for determining which of a plurality of predetermined zones said output from said second air-fuel ratio sensor falls in, said air-fuel ratio correction amount-changing means of said deterioration-determining means executes increasing or decreasing the value of said air-fuel ratio correction amount, based on said output from said second air-fuel ratio sensor when said output from said second air-fuel ratio sensor continuously remains within one of said plurality of said predetermined zones over a predetermined time period.

7. An air-fuel ratio sensor deterioration-detecting system as claimed in claim 6, wherein said determining means of said deterioration-determining means determines that said second air-fuel ratio sensor is deteriorated when said output from said second air-fuel ratio sensor continuously remains within one of said plurality of said predetermined zones over a second predetermined time period after said air-fuel ratio correction amount has been increased or decreased by said air-fuel ratio correction amount-changing means.

* * * * *